US010607438B2

(12) United States Patent
Froy

(10) Patent No.: US 10,607,438 B2
(45) Date of Patent: Mar. 31, 2020

(54) ELECTRONIC GAMING MACHINE WITH MOVABLE DISPLAY DEVICE

(71) Applicant: IGT, Las Vegas, NV (US)

(72) Inventor: David Froy, Lakeville-Westmorland (CA)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/046,238

(22) Filed: Jul. 26, 2018

(65) Prior Publication Data

US 2020/0035061 A1 Jan. 30, 2020

(51) Int. Cl.
*G07F 17/32* (2006.01)
*G07F 17/34* (2006.01)

(52) U.S. Cl.
CPC ..... *G07F 17/3213* (2013.01); *G07F 17/3267* (2013.01); *G07F 17/34* (2013.01)

(58) Field of Classification Search
CPC ..... G07F 17/3211; G07F 17/3213; G07F 17/3216; G07F 17/3227
See application file for complete search history.

(56) References Cited

U.S. PATENT DOCUMENTS 6,646,695 B1 * 11/2003 Gauselmann ..... G07F 9/10 345/31
6,715,756 B2 4/2004 Inoue
7,371,172 B2 5/2008 Inoue
7,572,185 B2 8/2009 Seelig et al.
7,780,534 B2 8/2010 Wudtke
8,323,114 B2 12/2012 Burak et al.
8,454,436 B2 6/2013 Klostermann et al.
8,485,881 B2 7/2013 Griswold et al.
8,740,706 B2 6/2014 Klein et al.
8,974,297 B2 3/2015 Massing et al.
9,116,662 B1 * 8/2015 Song ..... G06F 1/1601
9,123,290 B1 * 9/2015 Cho ..... G06F 1/1652
9,510,440 B2 * 11/2016 Nam ..... H05K 1/028
9,516,775 B2 * 12/2016 Park ..... G02F 1/133305
9,645,605 B2 * 5/2017 Park ..... H04N 5/64
9,746,701 B2 * 8/2017 Sung ..... G09F 9/301
9,773,370 B2 9/2017 Borissov et al.
9,980,399 B2 * 5/2018 Cho ..... G09F 9/301
10,198,898 B2 2/2019 Chun
2007/0287530 A1 * 12/2007 Seelig ..... G07F 17/34 463/20
2008/0058051 A1 * 3/2008 Seelig ..... G07F 17/3202 463/16
2008/0268944 A1 10/2008 Wudtke
2009/0233681 A1 9/2009 Tsukahara
2009/0264194 A1 10/2009 Kompella
(Continued)

OTHER PUBLICATIONS

Ryan Witwam, Extremetech, "Samsung Demos Stretchable OLED Display" May 30, 2017 (3 pages).

*Primary Examiner* — Steven J Hylinski
(74) *Attorney, Agent, or Firm* — Neal, Gerber & Eisenberg LLP

(57) ABSTRACT

An electronic gaming machine including a housing that supports a movable display device that is movable to a first position and to a second position. The electronic gaming machine may be configured to cause the movable display device to display a play of a first game in the first position and cause the display device to display a play of a second game in the second position.

21 Claims, 13 Drawing Sheets

(56) References Cited

U.S. PATENT DOCUMENTS

2010/0311494 A1* 12/2010 Miller ..... A63F 1/18
463/22
2012/0220353 A1* 8/2012 Massing ..... G07F 17/3213
463/16
2012/0329528 A1* 12/2012 Song ..... H04M 1/0268
455/566
2013/0002572 A1* 1/2013 Jin ..... G02F 1/133305
345/173
2013/0102390 A1 4/2013 Klein et al.
2013/0321264 A1* 12/2013 Park ..... G06F 3/01
345/156
2014/0357364 A1* 12/2014 Chudek ..... G07F 17/3211
463/31
2015/0009635 A1* 1/2015 Kang ..... G09F 9/301
361/749
2015/0234513 A1* 8/2015 Jiang ..... G06F 3/0412
345/174
2015/0241926 A1* 8/2015 Park ..... G06F 3/016
345/173
2015/0356926 A1* 12/2015 Bae ..... H01L 51/5253
345/212
2016/0147262 A1* 5/2016 Lee ..... G06F 1/1626
345/173
2016/0183364 A1* 6/2016 Choi ..... G06F 1/1652
361/679.01

* cited by examiner

ELECTRONIC GAMING MACHINE WITH MOVABLE DISPLAY DEVICE

BACKGROUND

Electronic gaming machines ("EGMs") may enable play of wagering games. EGMs may include a primary wagering game, and certain EGMs may also include one or more secondary games. EGMs may initiate a play of the primary wagering game following: (1) receipt of a wager input by the player (such as an actuation of a wager button by a player) that indicates how much the player desires to wager; and/or (2) receipt of a game initiation input by the player (such as an actuation of a play button by the player). EGMs may determine any awards for a play of the primary wagering game based on a randomly determined outcome of the play of the primary wagering game and the wager amount.

SUMMARY

In various embodiments, the present disclosure provides an electronic gaming machine including a movable display device, and a method of operating an electronic gaming machine including a moveable display device.

In various embodiments, the electronic gaming machine includes a housing; and a movable display device supported by the housing, the movable display device including: a supporting frame, a stretchable organic light-emitting diode ("OLED") display configured to move to a first position wherein the stretchable OLED display is in a substantially flat position, and to a different second position wherein the stretchable OLED display is curved in a first direction, and a display actuator connecting the stretchable OLED display to the supporting frame, and configured to move the stretchable OLED display to the first position, from the first position to the second position, and from the second position to the first position. In certain such embodiments, the electronic gaming machine includes a processor and a memory device that stores a plurality of instructions, which when executed by the processor, cause the movable display device to display a first set of game displays in the first position and a different second set of game displays in the second position. In certain such embodiments, the first set of game displays include images that are part of a primary wagering game, and the second set of game displays include images that are part of a secondary game.

In various other embodiments, the electronic gaming machine includes a housing; a movable display device supported by the housing, the movable display device including: a supporting frame, a stretchable organic light-emitting diode ("OLED") display connected to a screen supporter, said display and said screen supporter configured to move to a first position wherein the stretchable OLED display is in a substantially flat position, and to a different second position wherein the stretchable OLED display is curved in a first direction, and a display actuator connecting the screen supporter, and configured to move the screen supporter and the stretchable OLED display to the first position, from the first position to the second position, and from the second position to the first position, the display actuator including an upper display actuator connected to an upper rear portion of the screen supporter and a lower display actuator connected to a lower rear portion of the screen supporter; a processor; and a memory device that stores a plurality of instructions, which when executed by the processor, cause the movable display device to display a first set of game displays in the first position and a different second set of game displays in the second position.

Additional features and advantages are described in, and will be apparent from, the following Detailed Description and the Figures.

DETAILED DESCRIPTION

EGM—with Movable Display Device

Figure 1:
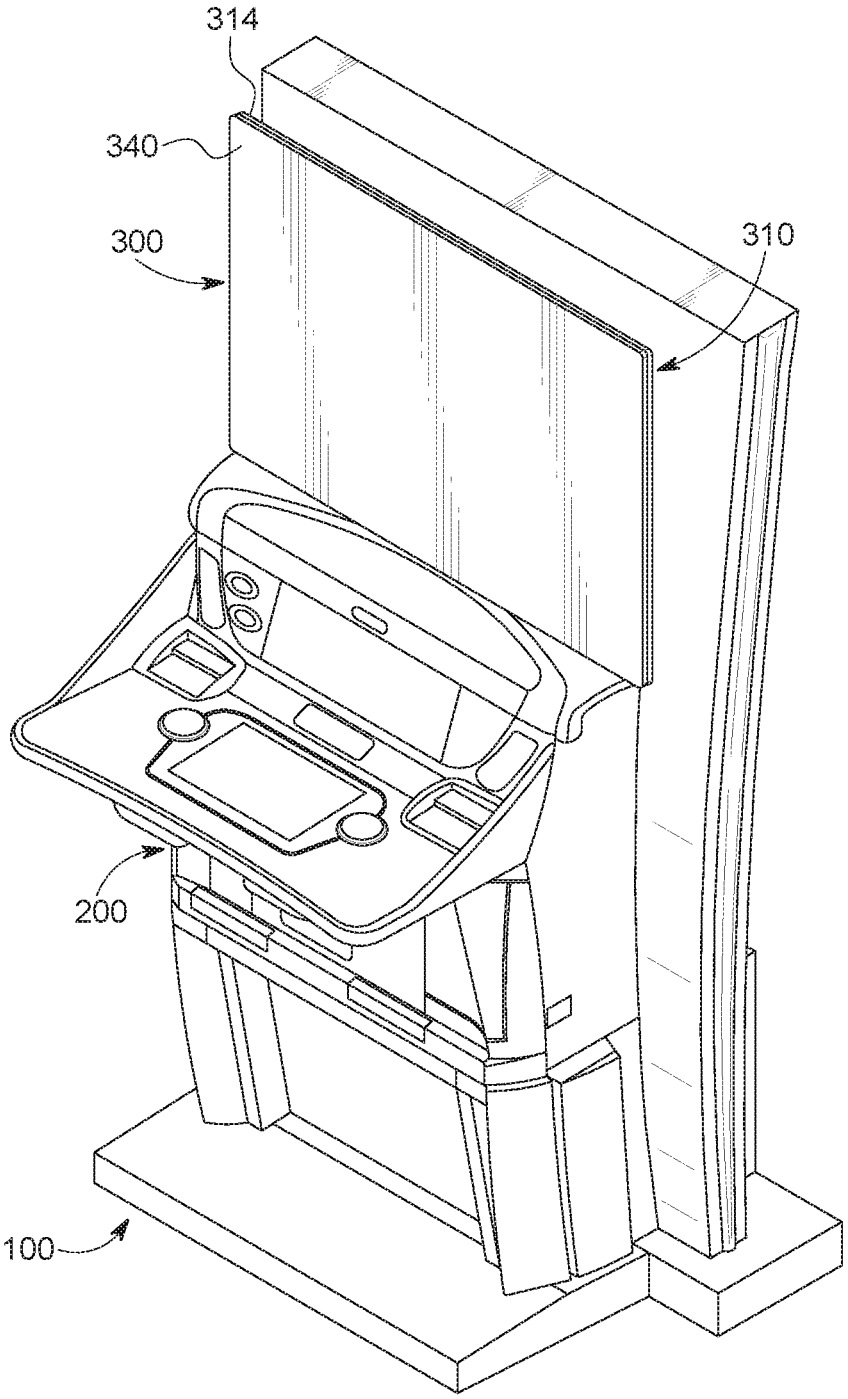
FIG. 1 is a front perspective view of one example embodiment of an electronic gaming machine ("EGM") of the present disclosure, and showing a movable display device of the EGM in a first position.
Figure 2:
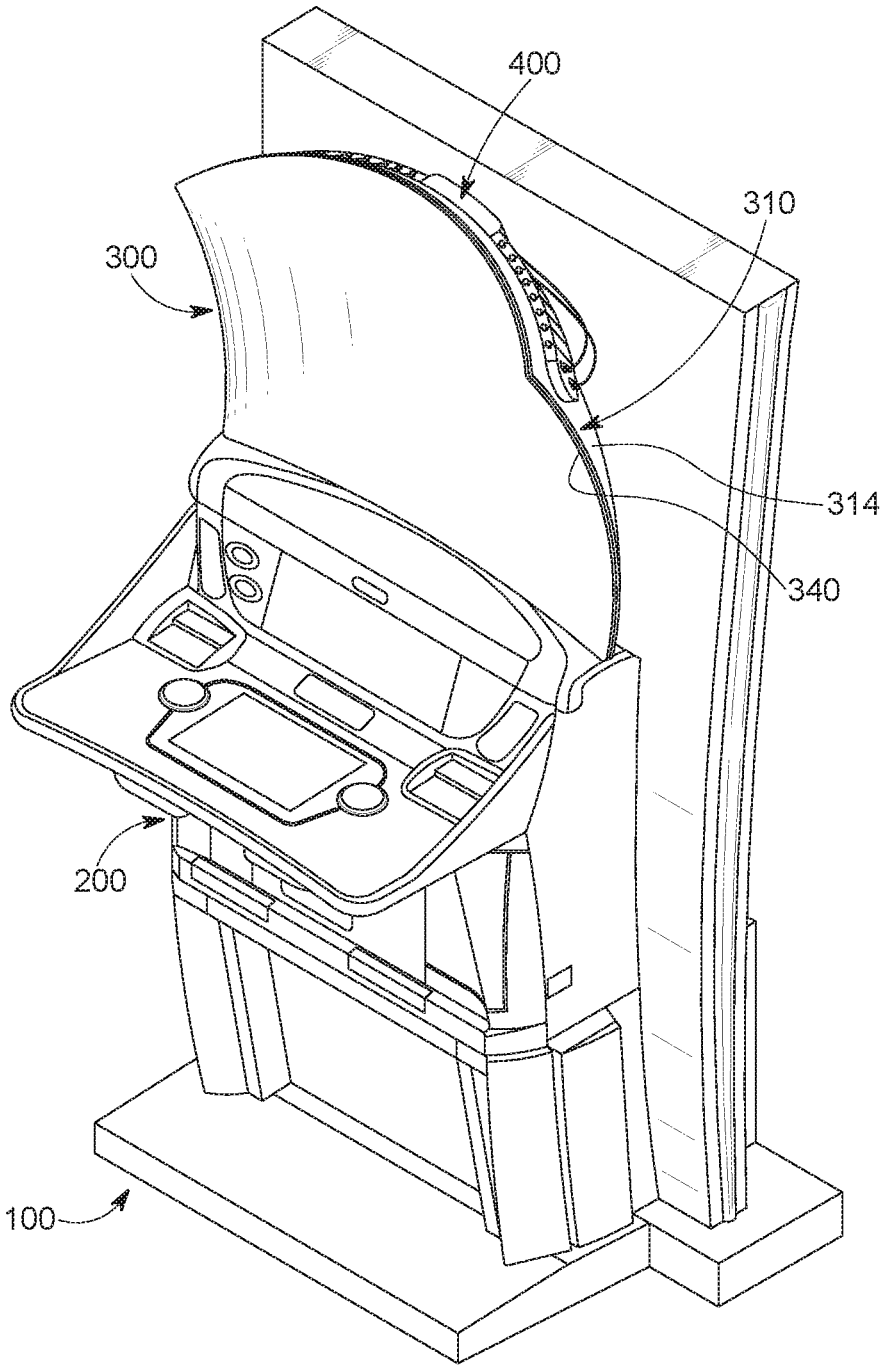
FIG. 2 is a front perspective view of the EGM of FIG. 1, and showing the movable display device of the EGM in a second different position.
Figure 3:
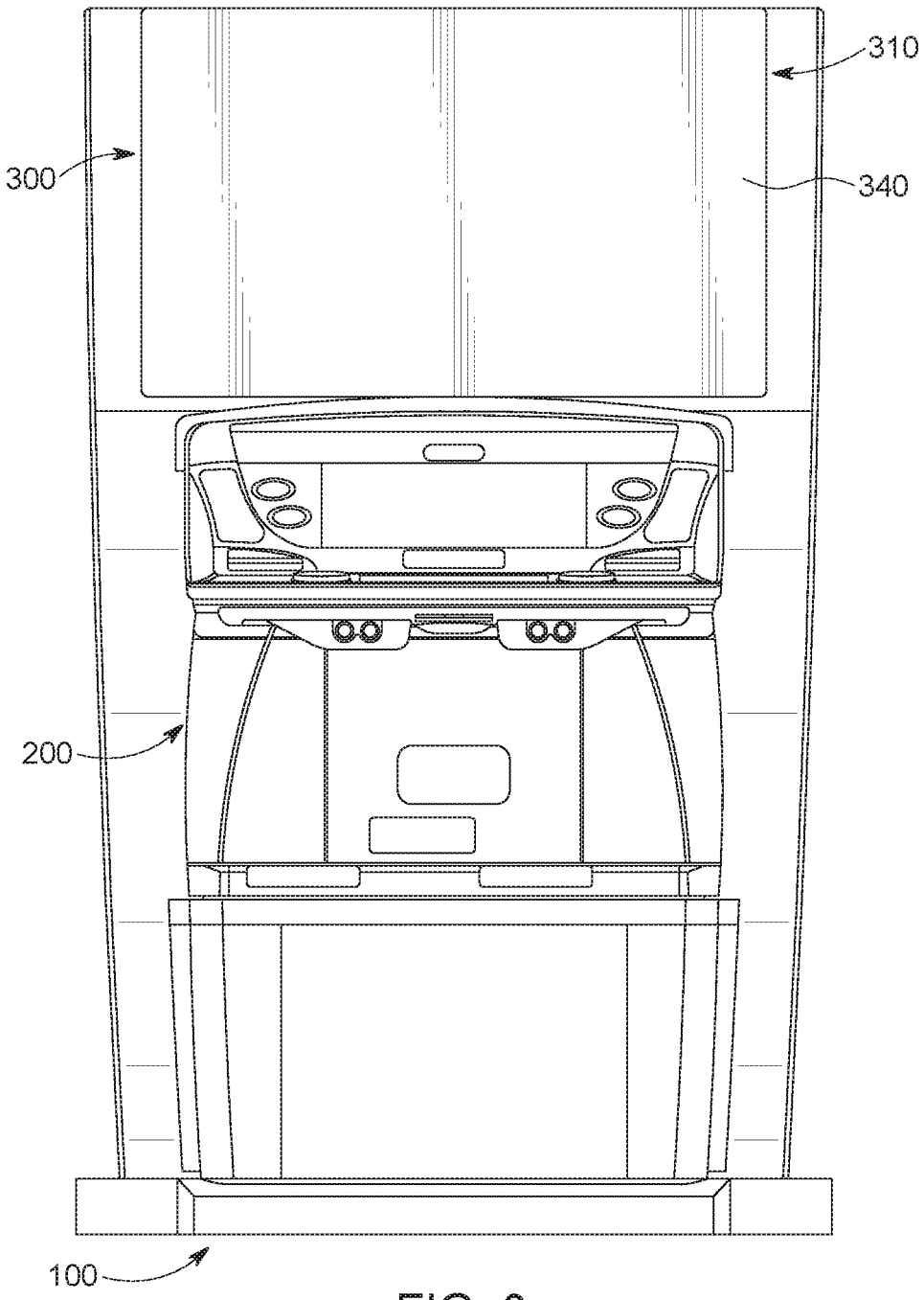
FIG. 3 is a front view of the EGM of FIG. 1, and showing the movable display device of the EGM in the first position.
Figure 4:
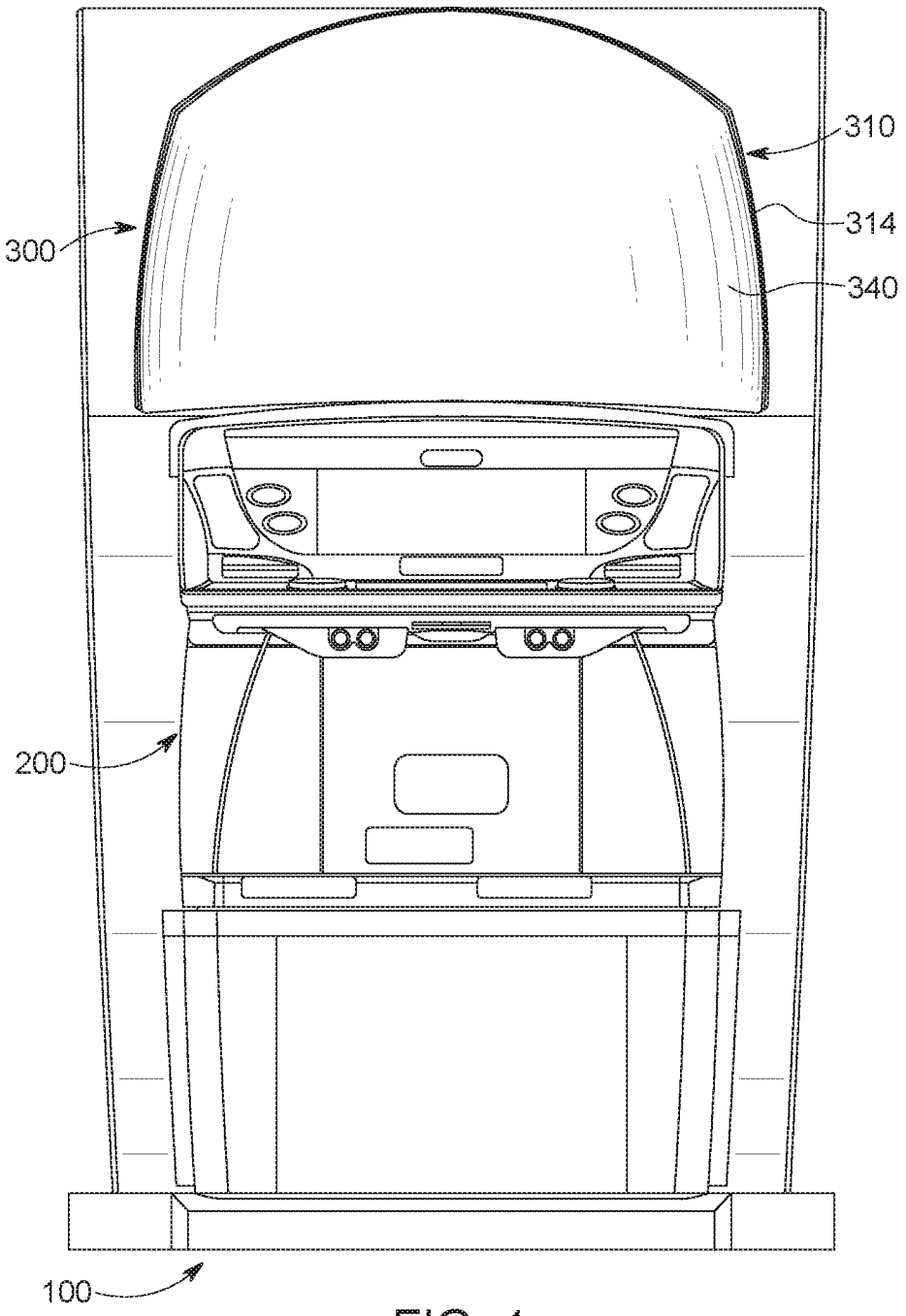
FIG. 4 is a front view of the EGM of FIG. 1, and showing the movable display device of the EGM in the second position.
Figure 5:
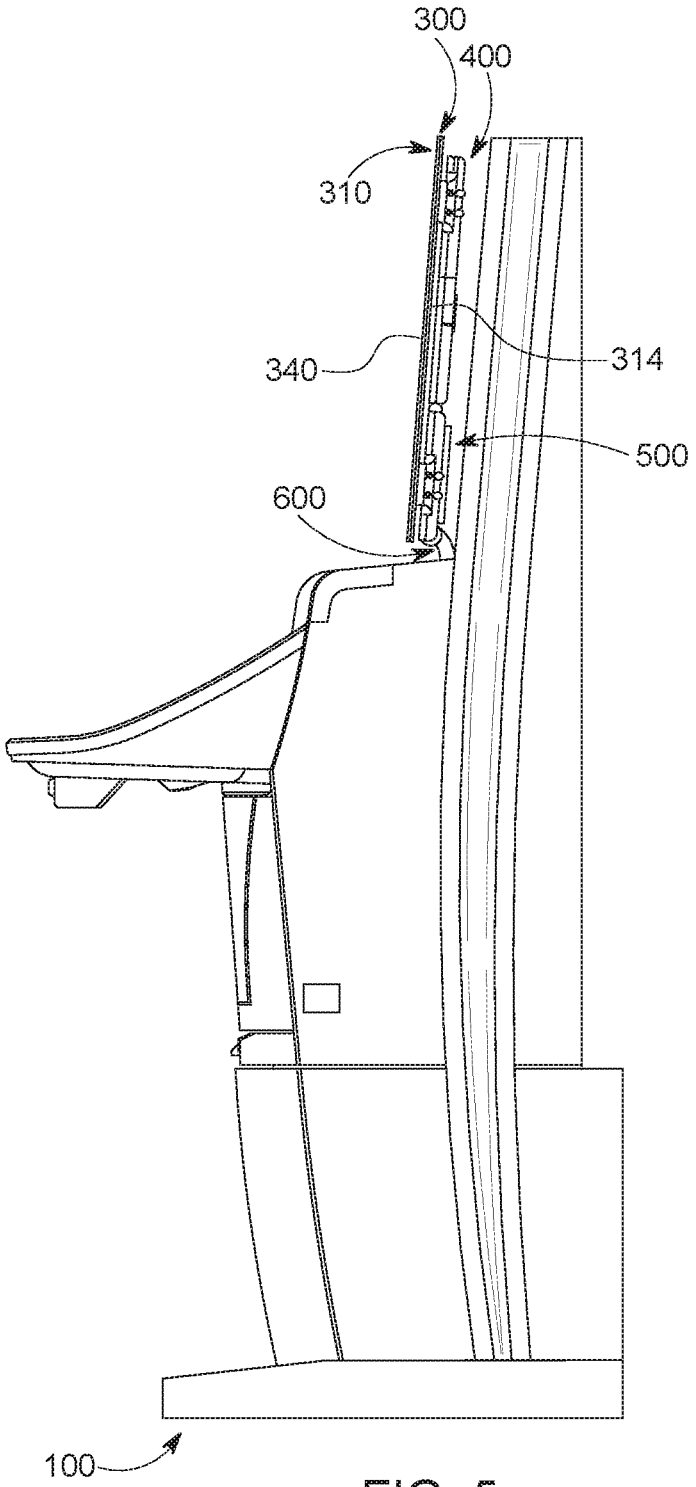
FIG. 5 is a side view of the EGM of FIG. 1, and showing the movable display device of the EGM in the first position.

Various embodiments of the present disclosure provide an EGM including a movable display device, and a method of operating an EGM including a moveable display device. For brevity and clarity, and unless specifically stated otherwise, the term "EGM" is used herein to refer to an electronic gaming machine (such as but not limited to a slot machine, a video poker machine, a video card machine, a video lottery terminal (VLT), a video keno machine, or a video bingo machine).

Referring now to FIGS. 1 to 10, one example embodiment of the EGM of the present disclosure is generally illustrated and indicated by numeral 100. This example EGM 100 generally includes a housing 200 that supports a plurality of suitable output devices (not labeled except for movable display device 300) and a plurality of suitable input devices (not labeled), among various other components. Examples of these output devices and input devices are provided below. In this illustrated example embodiment, the plurality of output devices includes the movable display device 300. In this illustrated example embodiment, the movable display device 300 is movable from a first position shown in FIGS.

1, 3, 5, 7, 7A, and 10 to a different second position shown in FIGS. 2, 4, 6, 8, 8A, and 9 (and back to the first position).

In this illustrated example embodiment, the EGM 100 and particularly the movable display device 300 is configured to display a first set of game displays (not shown) in the first position and a second different set of game displays (not shown) in the different second position. More specifically, in this illustrated example embodiment, the first set of game displays include the images that are part of or associated with plays of a first game such as a primary wagering game, and the second set of game displays include the images that are part of or associated with plays of a second game such as a secondary game. In this illustrated example embodiment, the first set of game displays include the game outcomes and awards, and other functionality and information of or related to the first game, and the second set of game displays include the game outcomes and awards, and other functionality and information of or related to the second game. It should be appreciated that present disclosure contemplates that the first position of the movable display device 300 of the EGM 100 can be employed to display any of a first set of images and that the second position of the movable display device 300 of the EGM 100 can be employed to display any of a second set of images. It should also be appreciated that the first set and second set of images can have no overlapping images, or can alternatively have one or more of the same images or related images.

In this illustrated example embodiment, the plurality of player input devices (not labeled) enable the player to play one or more first games such as one or more primary wagering games provided by the EGM 100. Such player input devices can also include one or more of the input devices described below in the second section of this detailed description. These player input devices are physically touchable or activatable by the player to enable the player to make inputs into the EGM 100. The output devices and input devices of the EGM are configured such that a player may operate the EGM 100 while standing or sitting, but preferably operates the EGM 100 while the player (not shown) is sitting in front of the EGM 100 such that the player's head (not shown) is approximately at the same height as the vertical middle area of the movable display device 300.

Figure 11:
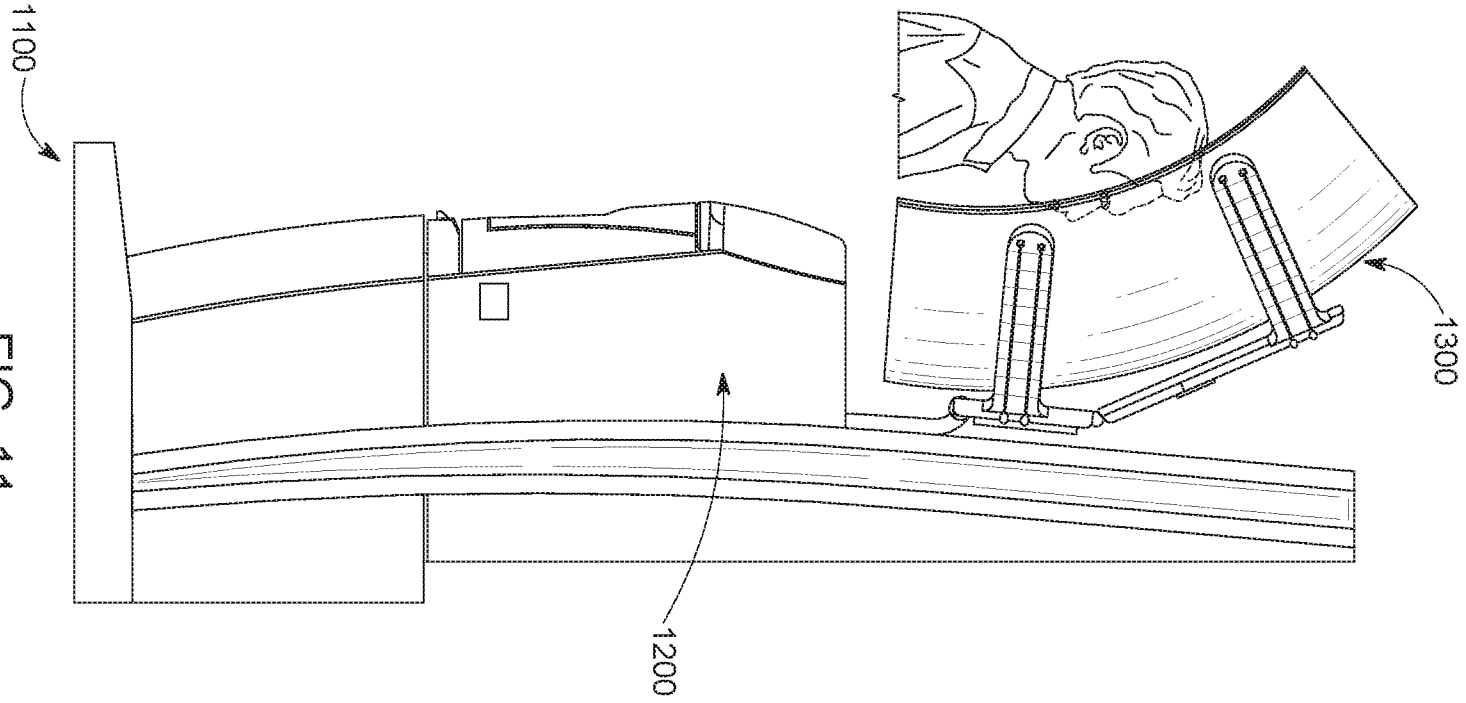
FIG. 11 is a side view of an alternative embodiment of the EGM of the present disclosure showing an alternatively configured movable display device of an EGM in the second position and relative to a player's head.

It should be appreciated that the sizes and configurations of the EGM, the cabinet of the EGM, the player input devices (including the button panel) of the EGM, and the movable display device of the EGM—as well as the relative curvatures of the movable display screen my vary in accordance with the present disclosure. For instance, as shown in FIG. 11, the alternative EGM 1100 includes an alternatively configured cabinet 1200, a reduced sized button panel (not labeled), and a larger movable display device 1300. FIG. 11 further shows a player's head and the movable display device more encompassing the player's head in this example embodiment.

Returning back to FIGS. 1 to 10, in this illustrated example embodiment, the movable display device 300 includes: (1) a stretchable organic light-emitting diode ("OLED") display 310 that is configured to move from the first position (shown in FIGS. 1, 3, 5, 7, 7A, and 10) to the different second position (shown in FIGS. 2, 4, 6, 8, 8A, and 9) and back to the first position; (2) a display actuator 400 configured to move the stretchable OLED display 310 from the first position to the different second position and from the second position to the first position; and (3) a supporting frame 600. In certain embodiments, the frame 600 is stationary. In other embodiments, the frame 600 is vertically movable—such that the frame 600 is configured to move the stretchable OLED display 310 and the display actuator 400 upwardly and downwardly. In alternative embodiments that are not shown, the frame 600 can be configured to move the stretchable OLED display 310 to an area that is partially within the housing 200 of the EGM 100 when the display device 300 is in the first position, and move the stretchable OLED display 310 out of the housing 200 when the display device 300 is going to move to the second position.

In this illustrated example embodiment, in the first position, the stretchable OLED display 310 is in a substantially flat position or a flat position. In this illustrated example embodiment, in the second position, the stretchable OLED display 310 is in a multi-curved position. In this illustrated example embodiment, the multi-curved position is curved in both a first direction (that is a horizontal direction or along an X-axis in this illustrated example embodiment) and in a different second direction (that is a vertical direction or along a Y-axis in this illustrated example embodiment).

In this illustrated example embodiment, the stretchable OLED display 310 is stretched from the central portion to the outer ends to make the stretchable OLED display 310 cover: (1) a substantial portion of player's side-to-side field (such as approximately 180 degrees of the of the player's side-to-side field of view); and (2) a substantial portion of the player's top-to-bottom field of view. It should be appreciated that the stretchable OLED display of the present disclosure can be alternatively sized and configured to cover all, substantially all, or a majority of a player's side-to-side and top-to-bottom fields of view in accordance with the present disclosure.

In this illustrated example embodiment, the stretchable OLED display 310 includes: (1) a screen supporter 314; and (2) an image display screen 340 supported by the screen supporter 314. In additional or alternative embodiments, the display device 300 and specifically the display 310 includes a touch screen (not shown) supported by the screen supporter 314 and attached to and positioned in front of and adjacent to the image display screen 340. It should thus be appreciated that the display can be alternatively configured in accordance with the present disclosure. In further alternative embodiments, the EGM includes a suitable player gesture tracking system, a suitable player eye tracking system, and/or a suitable player head tracking system.

Figure 6:
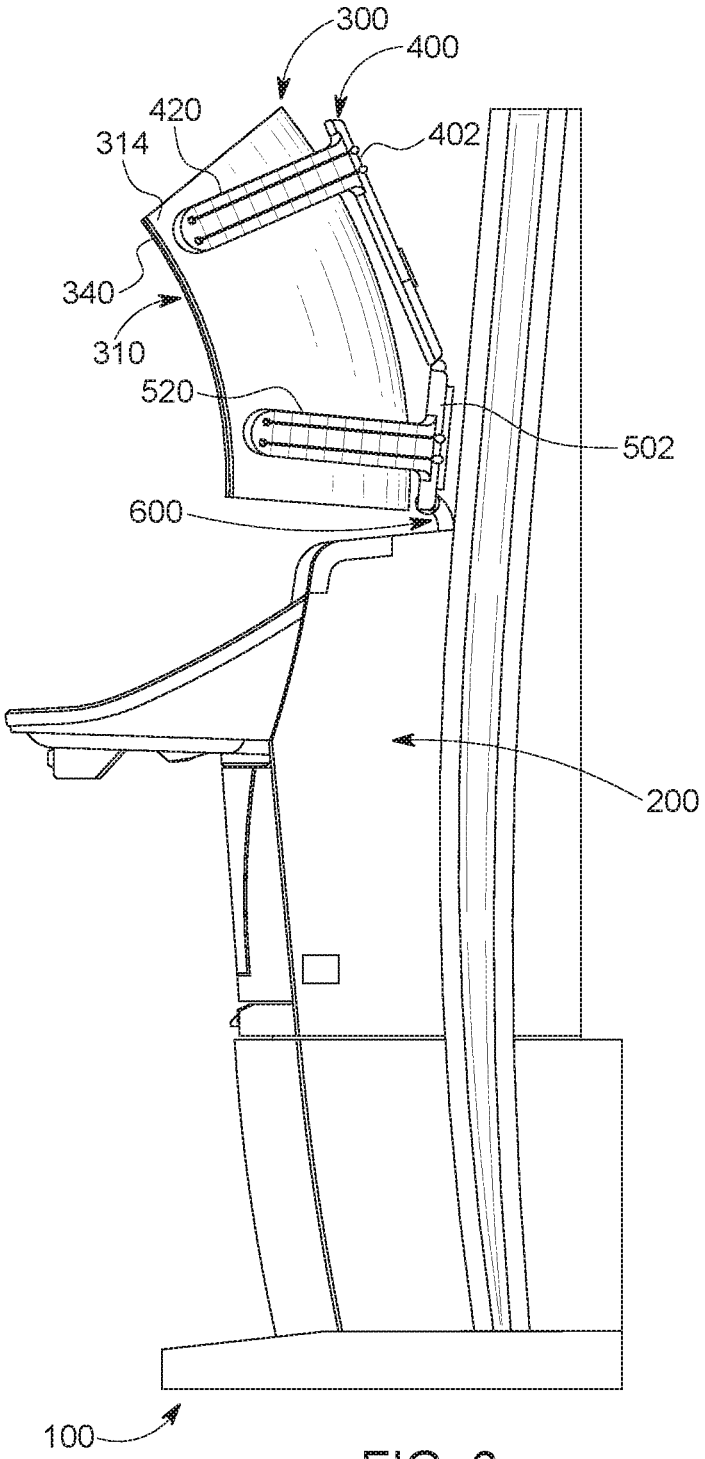
FIG. 6 is a side view of the EGM of FIG. 1, and showing the movable display device of the EGM in the second position.
Figure 7:
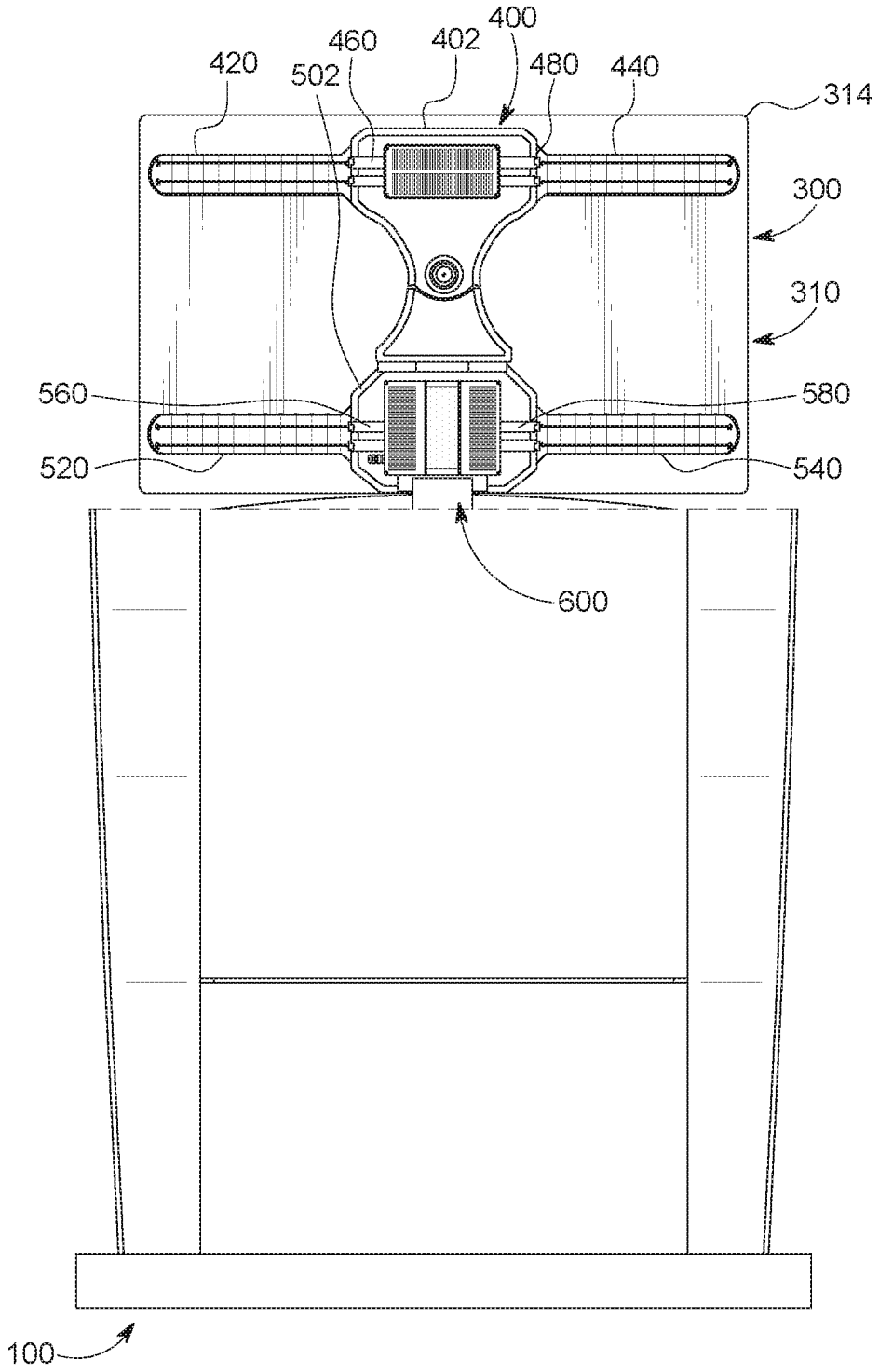
FIG. 7 is a rear view of the EGM, and showing the movable display device of the EGM in the first position.
Figure 7A:
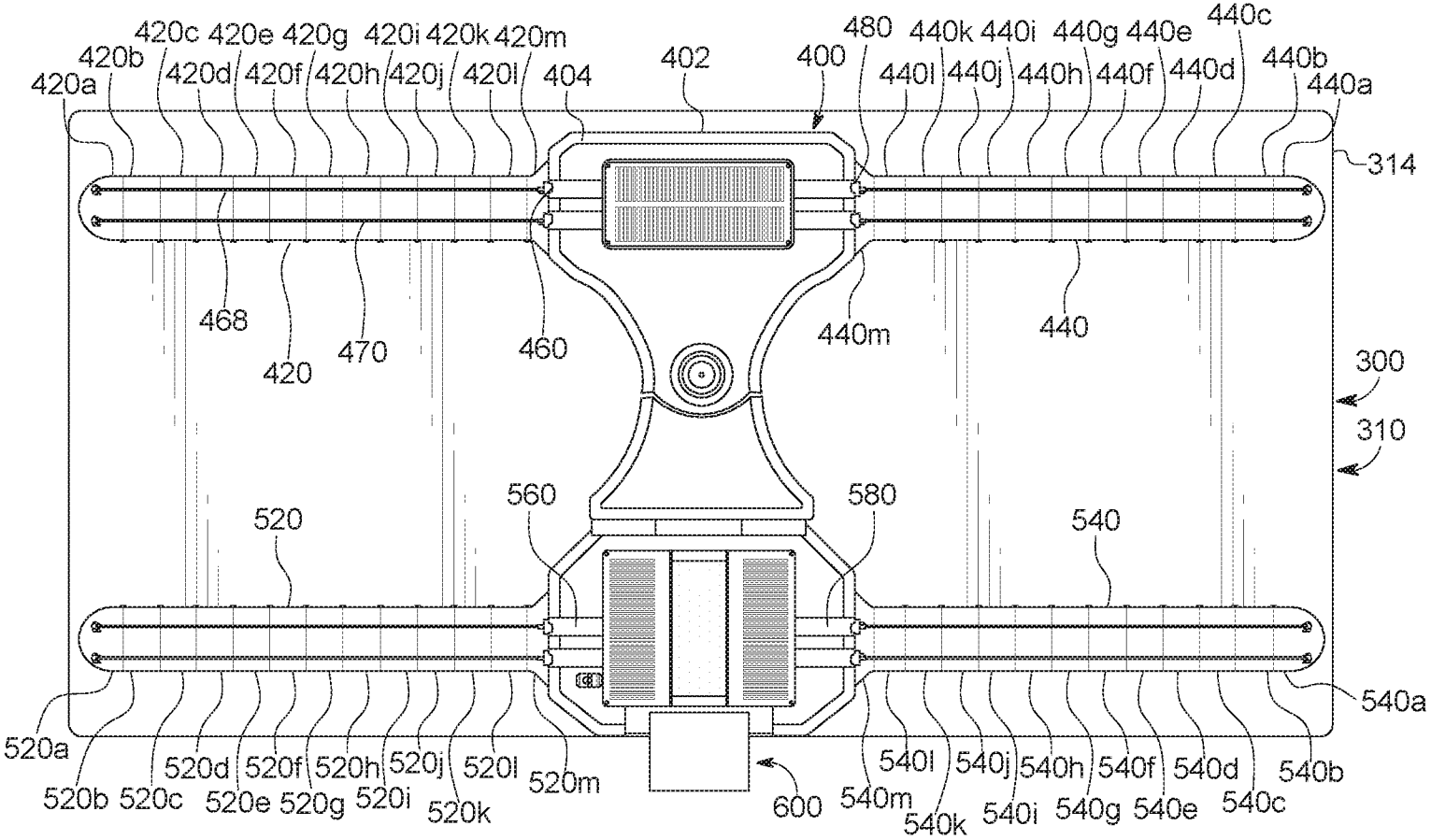
FIG. 7A is an enlarged rear view of the movable display device of the EGM in the first position.
Figure 8:
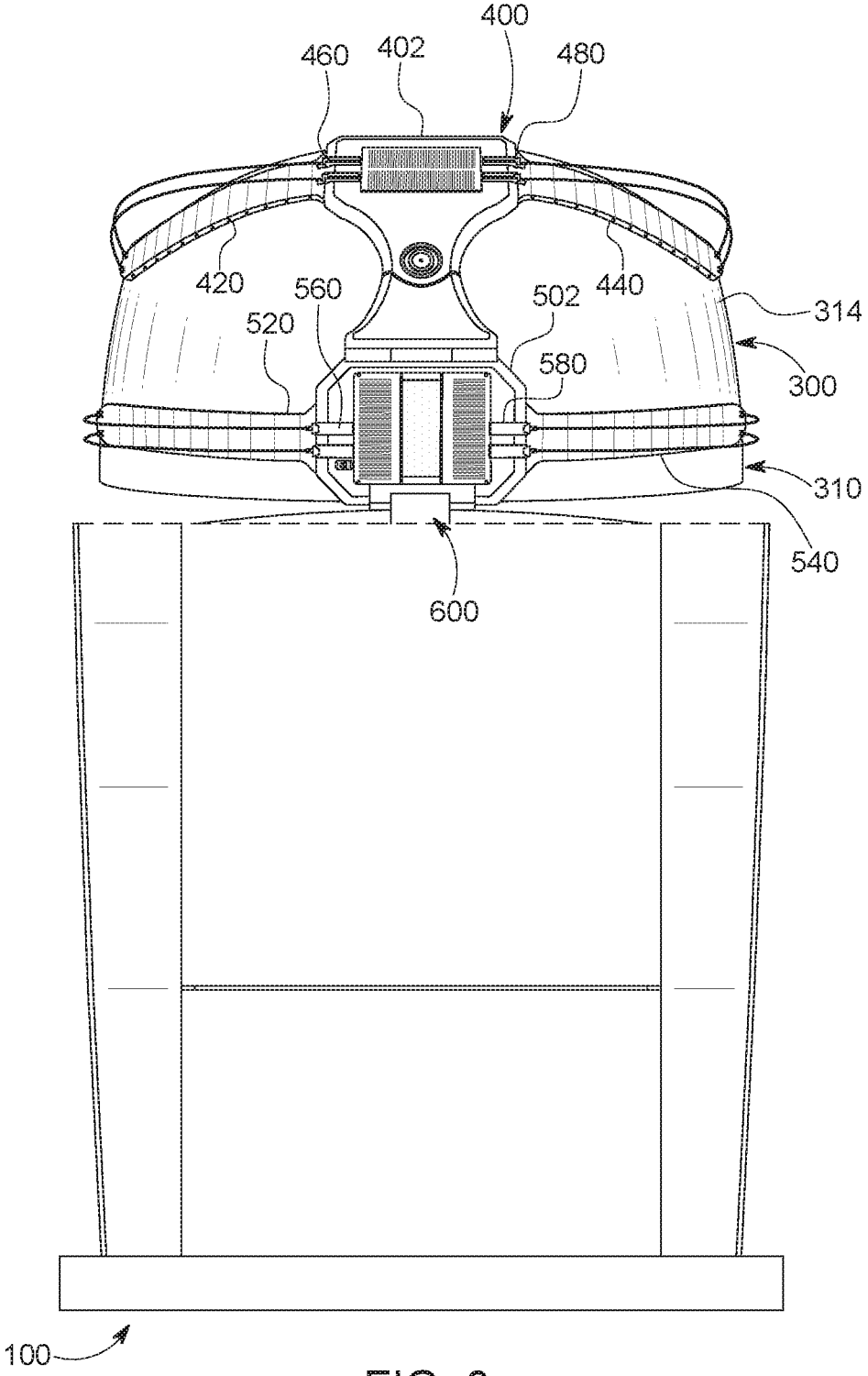
FIG. 8 is a rear view of the EGM, and showing the movable display device of the EGM in the second position.
Figure 8A:
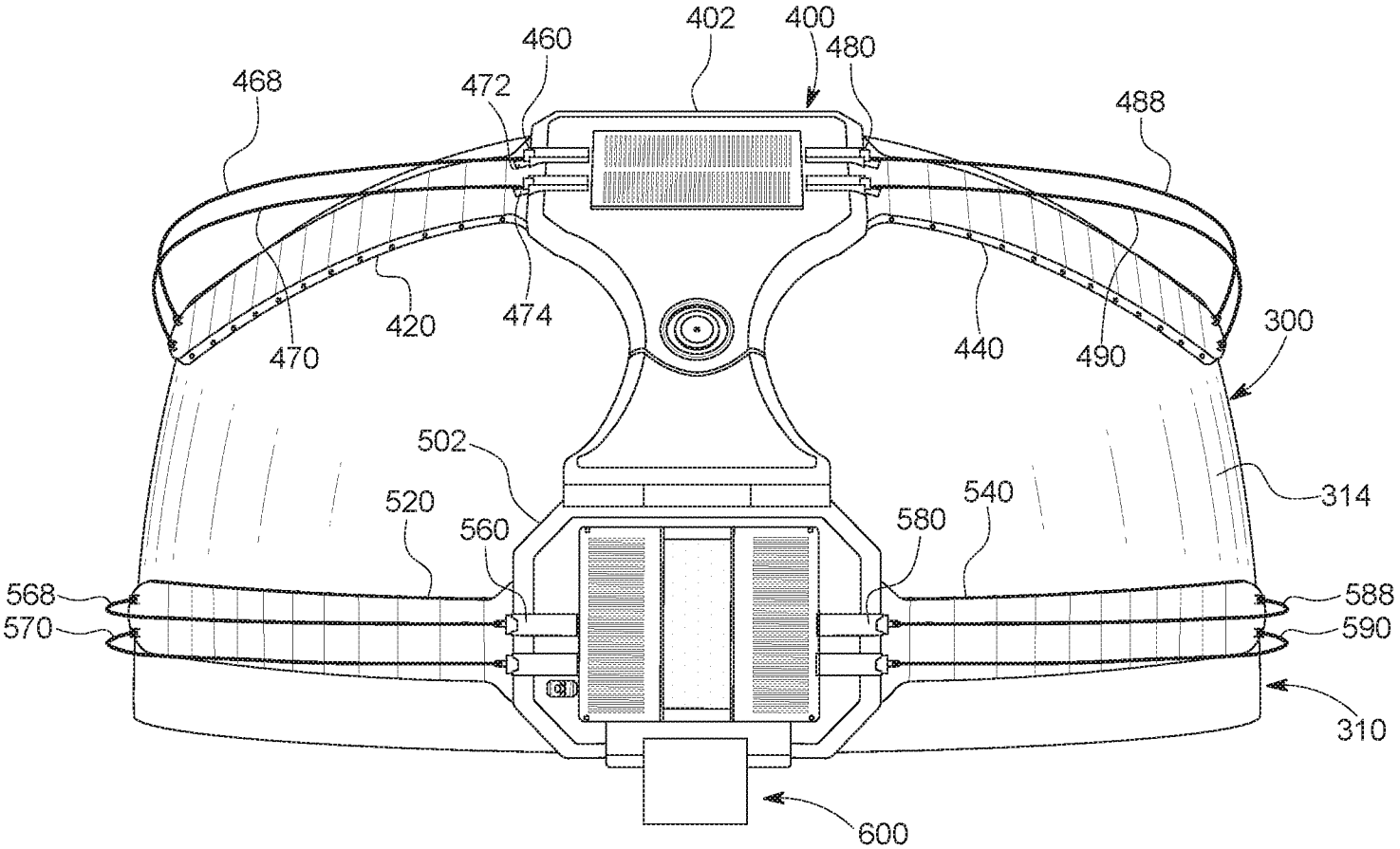
FIG. 8A is an enlarged rear view of the movable display device of the EGM in the second position.
Figure 9:
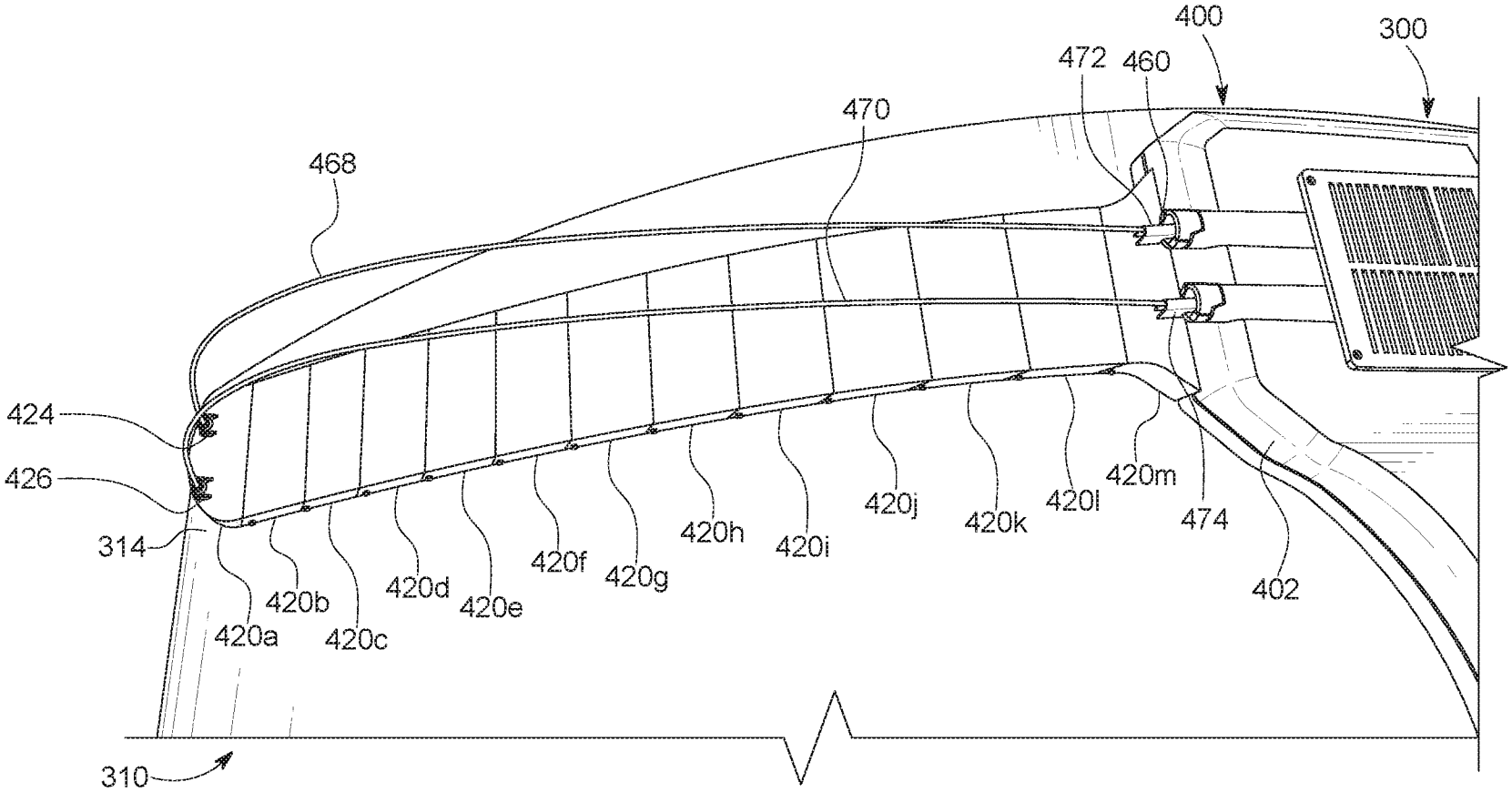
FIG. 9 is a further enlarged fragmentary rear view of part of the movable display device of the EGM in the second position.
Figure 10:
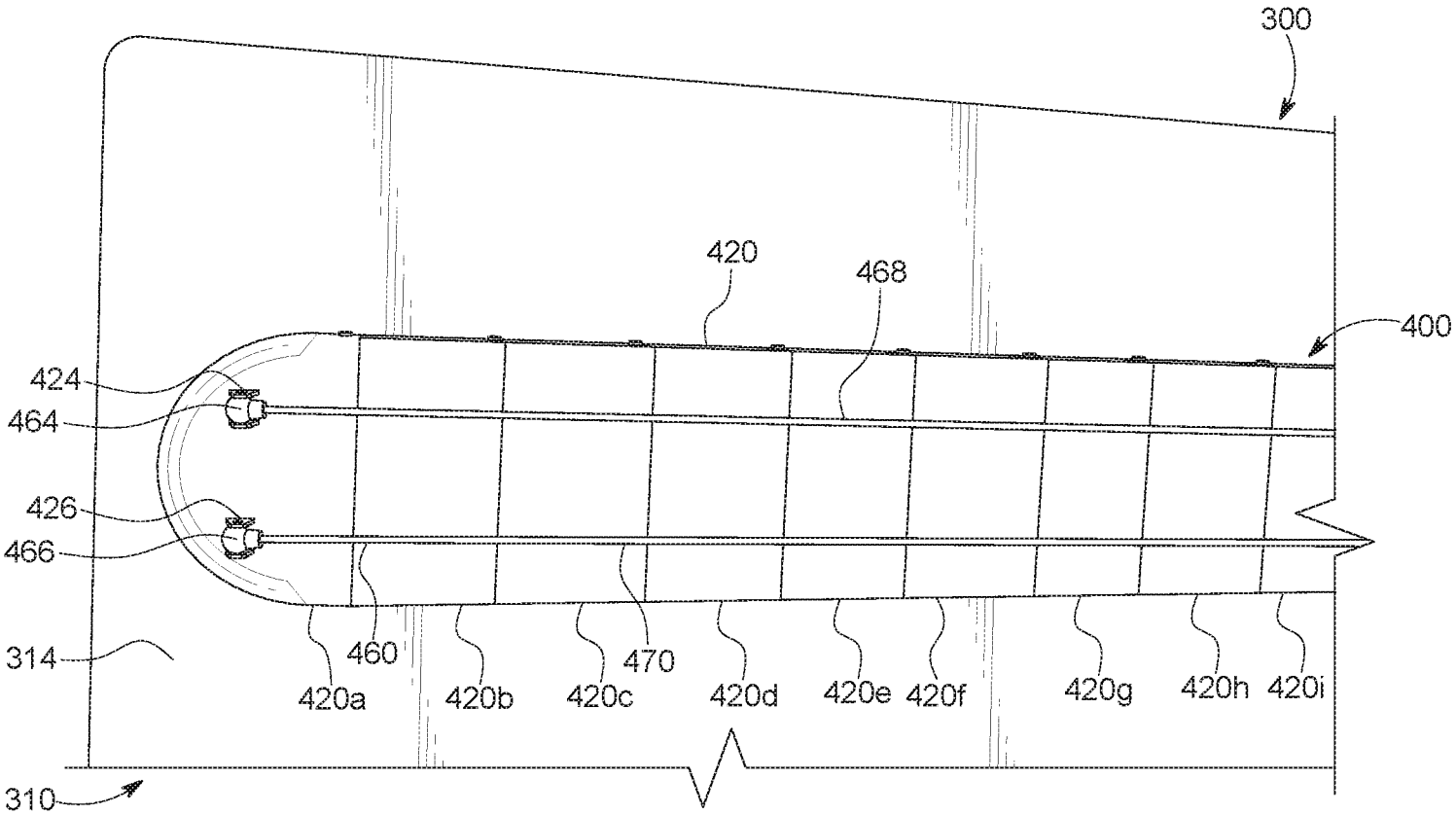
FIG. 10 is a further enlarged fragmentary rear view of the movable display device of the EGM in the first position.

In this illustrated example embodiment, the display actuator 400 includes: (1) an upper display actuator 402 suitably connected to the upper rear central and end portions of the screen supporter 314; and (2) a lower display actuator 502 suitably connected to the lower rear central and end portions of the screen supporter 314, as generally shown in FIGS. 5, 6, 7, 7A, 8, 8A, 9, and 10. In this illustrated example embodiment, the upper display actuator 402 and the lower display actuator 502 are suitably pivotally connected as best shown in FIG. 6. In this illustrated example embodiment, the display actuator 400 also includes a controller (not shown). The controller is configured to control the operation of the upper display actuator 402 and the lower display actuator 502, and thus control movement of the stretchable OLED display 310.

More specifically, the upper display actuator 402 includes: (1) a body 404 suitably fixedly connected to a first area (not labeled) of the upper rear central portion (not labeled) of the screen supporter 314; (2) a first bendable arm 420 transversely extending from a first side of the body 404 and suitably fixedly connected to a first side area (not labeled) of the upper rear portion (not labeled) of the screen supporter 314; (3) a second bendable arm 440 transversely extending from a second side of the body 404 and suitably connected to a second side area (not labeled) of the upper rear portion (not labeled) of the screen supporter 314; (4) a first arm mover assembly 460 suitably connected to the body 404 and the first arm 440; and (5) a second arm mover assembly 480 suitably connected to the body 404 and the second arm 460.

The body 404 includes a base (not labeled) suitably fixedly connected to the back of the screen supporter 314 and a cover (not labeled) suitably and removably connected to the base. The body 404 is configured to support part of the first arm mover assembly 460 and part of the second arm mover assembly 480. The cover is configured to cover and protect part of the first arm mover assembly 460 and part of the second arm mover assembly 480. It should be appreciated that these portions of the upper display actuator 402 can be alternatively configured in accordance with the present disclosure.

The first arm 420 includes: (1) a plurality of connected first arms sections 420*a* to 420*m* that are each suitably fixedly connected to the screen supporter 314 and movable with respect to one another; (2) a first bracket 424 fixedly connected to section 420*a*; and (3) a second bracket 426 also fixedly connected to section 420*a*. In certain example embodiments, the first arm 420 includes a plurality of suitable joints (not shown) that are employed to control the amount of curvature of the display 310.

The first arm mover assembly 460 includes: (1) a first pivot member 464 (best seen in FIG. 10) pivotally connected to the first bracket 424; (2) a second pivot member 466 (best seen in FIG. 10) pivotally connected to the second bracket 426; (3) a first flexible member 468 (such as a steel cable) including an outer end (not labeled) fixedly connected to the first pivot member 464 and thus pivotally connected to the first bracket 424; (4) a second flexible member 470 (such as a steel cable) including an outer end (not labeled) fixedly connected to the second pivot member 466 and thus pivotally connected to the second bracket 426; (5) a first flexible member actuator 472 fixedly connected to an inner end of the first flexible member 468 and fixedly connected to the base of the body 404; and (6) a second flexible member actuator 474 fixedly connected to an inner end of the second flexible member 470 and fixedly connected to the base of the body 404. The first flexible member 468 and the second flexible member 470 are suitable metal wires in this illustrated example embodiment.

In various embodiments, the first flexible member actuator 472 includes a linear motor suitably fixedly attached to the first flexible member 468. The first flexible member actuator 472 of the first arm mover assembly 460 is configured to apply tension to and pull the first flexible member 468 inwardly and closer to the body 404 to act on or apply forces to the first arm 420 which in turn applies force to move the screen supporter 314 to pull or move the screen 340 from the resting curved second position as shown in FIGS. 2, 4, 6, 8, 8A, and 9 to the substantially straight first position as shown in FIGS. 1, 3, 5, 7, 7A, and 10. The first flexible member actuator 472 of the first arm mover assembly 460 is also configured to release tension on the first flexible member 468 to allow the screen supporter 314 to move back from the tensioned position or from the substantially straight first position as shown in FIGS. 1, 3, 5, 7, 7A, and 10 to the resting curved second position as shown in FIGS. 2, 4, 6, 8, 8A, and 9.

Likewise, in various embodiments, the first flexible member actuator 474 includes a linear motor suitably fixedly attached to the second flexible member 470. The second flexible member actuator 474 of the first arm mover assembly 460 is configured to apply tension to and pull the second flexible member 470 inwardly and closer to the body 404 to act on or apply forces to the first arm 420 which in turn applies force to move the screen supporter 314 to pull or move the screen 340 from the resting curved second position as shown in FIGS. 2, 4, 6, 8, 8A, and 9 to the substantially straight first position as shown in FIGS. 1, 3, 5, 7, 7A, and 10. The second flexible member actuator 474 of the first arm mover assembly 460 is also configured to release tension on the second flexible member 470 to allow the screen supporter 314 to move back from the tensioned position or from the substantially straight first position as shown in FIGS. 1, 3, 5, 7, 7A, and 10 to the resting curved second position as shown in FIGS. 2, 4, 6, 8, 8A, and 9.

Under control of the controller, the first and second flexible member actuators 472 and 474 are thus configured to apply the respective forces on the first and second flexible members 468 and 470 at the same time under the control of the controller to pull or move the upper left part of the screen support 314 and the screen 340 from the resting curved second position as shown in FIGS. 2, 4, 6, 8, 8A, and 9 to the substantially straight first position as shown in FIGS. 1, 3, 5, 7, 7A, and 10. Under control of the controller, the first and second flexible member actuators 472 and 474 are also configured to release the respective forces on the first and second flexible members 468 and 470 at the same time to allow the screen supporter 314 to move back from the tensioned position or from the substantially straight first position as shown in FIGS. 1, 3, 5, 7, 7A, and 10 to the resting curved second position as shown in FIGS. 2, 4, 6, 8, 8A, and 9.

Likewise, the second arm 440 includes: (1) a plurality of connected first arms sections 440*a* to 440*m* that are each suitably fixedly connected to the screen supporter 314 and movable with respect to one another; (2) a first bracket (not labeled) fixedly connected to section 440*a*; and (3) a second bracket (not labeled) also fixedly connected to section 440*a*. In certain example embodiments, the second arm 440 includes a plurality of suitable joints (not shown) that are employed to control the amount of curvature of the display 310.

The second arm mover assembly 480 includes: (1) a first pivot member (not labeled) pivotally connected to the first bracket; (2) a second pivot member (not labeled) pivotally connected to the second bracket; (3) a first flexible member 488 including an outer end fixedly connected to the first pivot member and thus pivotally connected to the first bracket; (4) a second flexible member 490 including an outer end fixedly connected to the second pivot member and thus pivotally connected to the second bracket; (5) a first flexible member actuator (not labeled) fixedly connected to an inner end of the first flexible member 488 and fixedly connected to the base of the body 404; and (6) a second flexible member actuator (not labeled) fixedly connected to an inner end of the second flexible member 490 and fixedly connected to the base of the body 404. The first flexible member 488 and the second flexible member 490 are suitable metal wires in this illustrated example embodiment.

The first flexible member actuator of the second arm mover assembly 480 is configured to apply tension to and pull the first flexible member 488 inwardly and closer to the body 404 to act on or apply forces to the second arm 440 which in turn applies force to move the screen supporter 314 to pull or move the screen 340 from the resting curved second position as shown in FIGS. 2, 4, 6, 8, and 8A to the substantially straight first position as shown in FIGS. 1, 3, 5, 7, and 7A. The first flexible member actuator of the second arm mover assembly 480 is also configured to release tension on the first flexible member 488 to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Likewise, the second flexible member actuator of the second arm mover assembly 480 is configured to apply tension to and pull the second flexible member 490 inwardly and closer to the body 404 to act on or apply forces to the second arm 440 which in turn applies force to move the screen supporter 314 to pull or move the screen 340 from the resting curved second position as shown in FIGS. 2, 4, 6, 8, and 8A to the substantially straight first position as shown in FIGS. 1, 3, 5, 7, and 7A. The second flexible member actuator of the second arm mover assembly 480 is also configured to release tension on the second flexible member 490 to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Under control of the controller, the first and second flexible member actuators are thus configured to apply the respective forces on the first and second flexible members 488 and 490 at the same time under the control of the controller to pull or move the upper right part of the screen support 314 and the screen 340 from the resting curved second position as shown in FIGS. 2, 4, 6, 8, and 8A to a substantially straight first position as shown in FIGS. 1, 3, 5, 7, and 7A. Under control of the controller, the first and second flexible member actuators are also configured to release the respective forces on the first and second flexible members 488 and 490 at the same time to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Likewise, the lower display actuator 502 includes: (1) a body 504 suitably fixedly connected to a first area (not labeled) of the lower rear central portion (not labeled) of the screen supporter 314; (2) a first bendable arm 520 transversely extending from a first side of the body 504 and suitably connected to a first side area (not labeled) of the lower rear portion (not labeled) of the screen supporter 314; (3) a second bendable arm 540 transversely extending from a second side of the body 504 and suitably fixedly connected to a second side area (not labeled) of the lower rear portion (not labeled) of the screen supporter 314; (4) a first arm mover assembly 560 suitably connected to the body 504 and the first arm 540; and (5) a second arm mover assembly 580 suitably connected to the body 504 and the second arm 560.

The body 504 includes a base (not labeled) suitably fixedly connected to the back of the screen supporter 314 and a cover (not labeled) suitably and removably connected to the base. The body 504 is configured to support part of the first arm mover assembly 560 and part of the second arm mover assembly 580. The cover is configured to cover and protect part of the first arm mover assembly 560 and part of the second arm mover assembly 580. It should be appreciated that these portions of the upper display actuator 502 can be alternatively configured in accordance with the present disclosure.

The first arm 520 includes: (1) a plurality of connected first arms sections 520*a* to 520*m* that are each suitably fixedly connected to the screen supporter 314 and movable with respect to one another; (2) a first bracket (not labeled) fixedly connected to section 520*a*; and (3) a second bracket (not labeled) also fixedly connected to section 520*a*. In certain example embodiments, the first arm 520 includes a plurality of suitable joints (not shown) that are employed to control the amount of curvature of the stretchable OLED display 310.

The first arm mover assembly 560 includes: (1) a first pivot member (not labeled) pivotally connected to the first bracket (not labeled); (2) a second pivot member (not labeled) pivotally connected to the second bracket (not labeled); (3) a first flexible member 568 (such as a steel cable) including an outer end fixedly connected to the first pivot member and thus pivotally connected to the first bracket; (4) a second flexible member 570 (such as a steel cable) including an outer end fixedly connected to the second pivot member and thus pivotally connected to the second bracket; (5) a first flexible member actuator (not labeled) fixedly connected to an inner end of the first flexible member 568 and fixedly connected to the base of the body 504; and (6) a second flexible member actuator (not labeled) fixedly connected to an inner end of the second flexible member 570 and fixedly connected to the base of the body 504. The first flexible member 568 and the second flexible member 570 are suitable metal wires in this illustrated example embodiment.

In various embodiments, the first flexible member actuator includes a linear motor suitably fixedly attached to the first flexible member 568. The first flexible member actuator of the first arm mover assembly 560 is configured to apply tension to and pull the first flexible member 568 inwardly and closer to the body 504 to act on or apply forces to the first arm 520 which in turn applies force to move the screen supporter 314 to pull or move the screen 340 from the resting curved second position as shown in FIGS. 2, 4, 6, 8, and 8A to the substantially straight first position as shown in FIGS. 1, 3, 5, 7, and 7A. The first flexible member actuator of the first arm mover assembly 560 is also configured to release tension on the first flexible member 568 to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Likewise, in various embodiments, the first flexible member actuator includes a linear motor suitably fixedly attached to the first flexible member 570. The second flexible member actuator of the first arm mover assembly 560 is configured to apply tension to and pull the second flexible member 570 inwardly and closer to the body 504 to act on or apply forces to the first arm 520 which in turn applies force to move the screen supporter 314 to pull or move the screen 340 from the resting curved second position as shown in FIGS. 2, 4, 6, 8, and 8A to the substantially straight first position as shown in FIGS. 1, 3, 5, 7, and 7A. The second flexible member actuator of the first arm mover assembly 560 is also configured to release tension on the second flexible member 570 to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Under control of the controller, the first and second flexible member actuators are thus configured to apply the respective forces on the first and second flexible members 568 and 570 at the same time under the control of the controller to pull or move the lower left part of the screen support 314 and the screen 340 from the resting curved second position as shown in FIGS. 2, 4, 6, 8, and 8A to a substantially straight first position as shown in FIGS. 1, 3, 5, 7, and 7A. Under control of the controller, the first and second flexible member actuators are also configured to release the respective forces on the first and second flexible members 568 and 570 at the same time to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Likewise, the second arm 540 includes: (1) a plurality of connected second arms sections 540*a* to 540*m* that are each suitably connected to the screen supporter 314 and movable with respect to one another; (2) a first bracket (not labeled) fixedly connected to section 540*a*; and (3) a second bracket (not labeled) also fixedly connected to section 540*a*. In certain example embodiments, the first arm 540 includes a plurality of suitable joints (not shown) that are employed to control the amount of curvature of the stretchable OLED display 310.

The second arm mover assembly 580 includes: (1) a first pivot member (not labeled) pivotally connected to the first bracket; (2) a second pivot member (not labeled) pivotally connected to the second bracket; (3) a first flexible member 588 including an outer end, fixedly connected to the first pivot member and thus pivotally connected to the first bracket; (4) a second flexible member 590 including an outer end fixedly connected to the second pivot member and thus pivotally connected to the second bracket; (5) a first flexible member actuator (not labeled) fixedly connected to an inner end of the first flexible member 588 and fixedly connected to the base of the body 504; and (6) a second flexible member actuator (not labeled) fixedly connected to an inner end of the second flexible member 590 and fixedly connected to the base of the body 504. The first flexible member 588 and the second flexible member 590 are suitable metal wires in this illustrated example embodiment.

The first flexible member actuator of the second arm mover assembly 580 is configured to apply tension to and pull the first flexible member 588 inwardly and closer to the body 504 to act on or apply forces to the second arm 540 which in turn applies force to move the screen supporter 314 to pull or move the screen 340 from the resting curved second position as shown in FIGS. 2, 4, 6, 8, and 8A to the substantially straight first position as shown in FIGS. 1, 3, 5, 7, and 7A. The first flexible member actuator of the second arm mover assembly 580 is also configured to release tension on the first flexible member 588 to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Likewise, the second flexible member actuator of the second arm mover assembly 580 is configured to apply tension to and pull the second flexible member 590 inwardly and closer to the body 504 to act on or apply forces to the second arm 540 which in turn applies force to move the screen supporter 314 to pull or move the screen 340 from the resting curved second position as shown in FIGS. 2, 4, 6, 8, and 8A to the substantially straight first position as shown in FIGS. 1, 3, 5, 7, and 7A. The second flexible member actuator of the second arm mover assembly 580 is also configured to release tension on the second flexible member 590 to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

Under control of the controller, the first and second flexible member actuators are thus configured to apply the respective forces on the first and second flexible members 588 and 590 at the same time under the control of the controller to pull or move the upper right part of the screen support 314 and the screen 340 from the resting curved second position as shown in FIGS. 2, 4, 6, 8, and 8A to the substantially straight first position as shown in FIGS. 1, 3, 5, 7, and 7A. Under control of the controller, the first and second flexible member actuators are also configured to release the respective forces on the first and second flexible members 588 and 590 at the same time to allow the screen supporter 314 to move back from the tensioned position or from the substantially straight first position as shown in FIGS. 1, 3, 5, 7, and 7A to the resting curved second position as shown in FIGS. 2, 4, 6, 8, and 8A.

It should be appreciated that the controller is configured to operate all of the flexible member actuators simultaneously to simultaneously move the respective portions of the display to the respective positions. It should also be appreciated that the controller can be suitably configured to suitably control a power supply assembly electrically connected to the flexible member actuators.

In this illustrated example embodiment, the supporting frame 600 includes an arm (not labeled) having a top end (not labeled) and a bottom end (not labeled). The top end is suitably connected to a bottom portion of the display actuator 502. The bottom end 396 is suitably connected to the housing of the EGM 300. The frame 600 thus connects the display device 300 to the housing 200.

In this illustrated example embodiment, a processor of the EGM 100 will automatically adjust the images displayed by the stretchable OLED display 310 to correct for possible distortion by the curvature of the stretchable OLED display 310 when in the second multi-curved position. In other words, it should be appreciated that in various embodiments, the EGM is configured to automatically adjust the images displayed by the display device 300 to correct for any distortion caused by the curvature of the display screen 340. It should be appreciate that this correction can be done by the EGM itself, or could be offloaded by a secondary computer processing the final rendered images to perform the distortion correction.

Various embodiments of the EMG of the present disclosure further include one or more suitable cameras (not shown) (such as one or more infrared ("IR") cameras) configured to facilitate one or more of player head tracking, player eye tracking, and player hand (or gesture) tracking. In various such embodiments of the present disclosure, the first time the player sits down and registers with the EGM, the EGM gives the player a calibration mini game to play to calibrate the eye tracking and/or head tracking system(s) of the EGM. In various such embodiments of the present disclosure, the EGM will also obtain one or more inputs from the player to enable the player to choose the player's preference on gestures the player wishes to use for different actions.

In certain such embodiments of the present disclosure, the EGM will use foveated rendering to reduce the amount of rendering needed by the display device. Foveated rendering uses eye tracking data to determine where on the screen the player is looking and enables more detail to be rendered where the player is looking and use lower resolution rendering in the peripheral of the player's vision where it is blurry to save bandwidth and processing power.

In other example embodiments of the present disclosure, the multi-curved position is curved in two different directions, where one or both of such directions are off-set from the horizontal and/or the vertical directions. In other example embodiments of the present disclosure, the stretchable OLED display is curved on only one direction (or along one axis) such as either the horizontal direction (along the X-axis) or the vertical direction (along the Y-axis).

It should be appreciated that the quantity, arrangement, and configuration of the arms and arm mover assemblies can vary in accordance with the present disclosure. For example, in other alternative embodiments, one or more arms and arm mover assemblies can extend in a vertical direction to control the vertical movement and curvature of the display device. In other alternative embodiments, each one of four arms and four corresponding arm mover assemblies can extend in angled directions (such as at 45 degree angles) from the rear center of the screen support toward the four corners of the screen support (in an X shaped pattern).

It should be appreciated from the above that in various embodiments, during plays of the primary wagering game, the display device 300 will be in the second position with the screen 340 flat (and in certain embodiments not shown partially hidden in the housing). In these embodiments, when a bonus is triggered, the EGM will cause the display device to move to the second curved position (which will includes in certain embodiments the screen 340 and the screen support 314 first rising out of the housing and then curving along the x and y axis to engulf the player's vision.

Thus, in various embodiments of the present disclosure, the screen 340 will be in the default screen location during the plays of the primary game and when a secondary game is triggered, the screen will expand and transform into a virtual reality format. For example, during a play of a secondary game, the EGM 100 will prompt the player to find flying enemies displayed by the screen 340 in the curved position. In certain example embodiments where the EGM includes a player gesture tracking system, the player can look at the flying enemies and can perform a "trigger finger" gesture and fire where the player is looking. In various such embodiments, the EGM will enable players to choose the gesture they want to use to fire in a configuration menu. In certain such embodiments, these preferences will be saved in a player account (such as stored on a mobile device or on a storage device in the cloud). In various example embodiments, for gestures, the EGM could either have the player make the motion the player wants to use for the gesture or could select from a list of pre-determined gestures.

In various other example embodiments that provide a virtual reality player experience, the EGM enables the player to pilot a flying spaceship. The EGM uses the screen 340 in the curved second position to display an inside of a cockpit of a ship. In certain such embodiments, the EGM enables the player to target objects with their eye gaze and enables the player to fire at the targets. In certain such embodiments, the EGM enables the player to target enemy ships with their eyes, and if the player holds their gaze on a target after a specified amount of time, the EGM determines that the target is hit. In certain such embodiments, the EGM enables the player to control the movement of the ship by looking at the edge of the screen and to turn the ship.

In various other example embodiments that provide a virtual reality player experience, during a play of a secondary game screen transforms to the curved second position for the player and shows the player a series of mazes that the player must traverse. The EGM enables the player to traverse the maze and choose paths based upon their gesture inputs. The EGM enables the player to jump over pits and collect coins to obtain awards. The EGM enables the player to grab the awards from the air with a pinching or grabbing gesture. The EGM enables the player to dodge obstacles by moving the player's body side to side. In certain such embodiments, the EGM enables the player to auto run through the level. In certain such embodiments, the EGM enables the player to swipe which direction the player wishes to traverse. In certain such embodiments, the EGM enable the player to do an upward gesture to make the character jump.

It should be appreciated from the above, that the movable display device provides an enhanced player interaction zone in front of the display device that can provide a plurality of different enhanced displays to the player when the movable display device is in the second curved position In various embodiments, the EGM will include a traditional ticket in ticket out printer and bill acceptor as well as a near field communication tap support for wireless payment using one or more of debit cards, credit cards, mobile devices and combination debit and player tracking cards such as for use in mixing of online and local play.

EGM—General Components and Operation

The EGM of the present disclosure can be controlled locally by one or more processors, and/or remotely or partially remotely by one or more remote processors, central servers, central controllers, or remote host. In various embodiments, the EGM of the present disclosure can be part of a gaming system (which is also part of the present disclosure) that includes one or more EGMs in combination with one or more remote processors, central servers, central controllers, or remote hosts. In such embodiments, the EGM is configured to communicate with the remote processors, central servers, central controllers, or remote hosts through a data network or remote communication link. In certain such embodiments, the EGM is configured to communicate with one or more other EGMs through the same data network or remote communication link or through a different data network or remote communication link.

In certain embodiments in which the gaming system includes an EGM in combination with a remote processor, central server, central controller, or remote host, the remote processor, central server, central controller, or remote host is any suitable computing device that includes at least one processor and at least one memory device or data storage device. As further described herein, the EGM includes at least one EGM processor configured to transmit and receive data or signals representing events, messages, commands, or any other suitable information between the EGM and the remote processor, central server, central controller, or remote host. The at least one processor of that EGM is configured to execute the events, messages, or commands represented by such data or signals in conjunction with the operation of the EGM. Moreover, the at least one processor of the remote processor, central server, central controller, or remote host is configured to transmit and receive data or signals representing events, messages, commands, or any other suitable information between the remote processor, central server, central controller, or remote host and the EGM. One, more than one, or each of the functions of the at least one processor of the EGM may be performed by the remote processor, the central server, the central controller, or the remote host.

In certain such embodiments, computerized instructions for controlling any games (such as any primary or base games and/or any secondary or bonus games) displayed by the EGM are executed by the remote processor, central server, central controller, or remote host. In such "thin client" embodiments, the remote processor, central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the remote processor, central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a remote processor, central server, central controller, or remote host, computerized instructions for controlling any primary or base games displayed by the EGM are communicated from the remote processor, central server, central controller, or remote host to the EGM in a thick client configuration, and computerized instructions for controlling any secondary or bonus games or other functions displayed by the EGM are executed by the remote processor, central server, central controller, or remote host in a thin client configuration.

In certain embodiments in which the gaming system includes: (a) an EGM configured to communicate with a remote processor, central server, central controller, or remote host through a data network; and/or (b) a plurality of EGMs configured to communicate with one another through a data network, the data network is a local area network (LAN) in which the EGMs are located substantially proximate to one another and/or the remote processor, central server, central controller, or remote host. In one example, the EGMs and the remote processor, central server, central controller, or remote host are located in a gaming establishment or a portion of a gaming establishment.

In other embodiments in which the gaming system includes: (a) an EGM configured to communicate with a remote processor, central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the remote processor, central server, central controller, or remote host. For example, one or more of the EGMs are located: (a) in an area of a gaming establishment different from an area of the gaming establishment in which the remote processor, central server, central controller, or remote host is located; or (b) in a gaming establishment different from the gaming establishment in which the remote processor, central server, central controller, or remote host is located. In another example, the remote processor, central server, central controller, or remote host is not located within a gaming establishment in which the EGMs are located. In certain embodiments in which the data network is a WAN, the gaming system includes a remote processor, central server, central controller, or remote host and an EGM each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a remote processor, central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the remote processor, central server, central controller, or remote host identifies a player prior to enabling that player to place any wagers on any plays of any wagering games. In one example, the remote processor, central server, central controller, or remote host identifies the player by requiring a player account of the player to be logged into via an input of a unique username and password combination assigned to the player. The remote processor, central server, central controller, or remote host may, however, identify the player in any other suitable manner, such as: by validating a player tracking identification number associated with the player; by reading a player tracking card or other smart card inserted into a card reader (as described below); by validating a unique player identification number associated with the player by the remote processor, central server, central controller, or remote host; or by identifying the EGM, such as by identifying the MAC address or the IP address of the Internet facilitator. In various embodiments, once the remote processor, central server, central controller, or remote host identifies the player, the remote processor, central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The remote processor, central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, the EGM includes a master gaming controller configured to communicate with and to operate with a plurality of peripheral devices.

The master gaming controller includes at least one processor. The at least one processor is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface of the master gaming controller; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices (such as input/output devices); and/or (5) controlling the peripheral devices. In certain embodiments, one or more components of the master gaming controller (such as the at least one processor) reside within a housing of the EGM (described below), while in other embodiments at least one component of the master gaming controller resides outside of the housing of the EGM.

The master gaming controller also includes at least one memory device, which includes: (1) volatile memory (e.g., RAM which can include non-volatile RAM, magnetic RAM, ferroelectric RAM, and any other suitable forms); (2) non-volatile memory (e.g., disk memory, FLASH memory, EPROMs, EEPROMs, memristor-based non-volatile solid-state memory, etc.); (3) unalterable memory (e.g., EPROMs); (4) read-only memory; and/or (5) a secondary memory storage device, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device resides within the housing of the EGM (described below), while in other embodiments at least one component of the at least one memory device resides outside of the housing of the EGM.

The at least one memory device is configured to store, for example: (1) configuration software, such as all the parameters and settings for a game playable on the EGM; (2) associations between configuration indicia read from an EGM with one or more parameters and settings; (3) communication protocols configured to enable the at least one processor to communicate with the peripheral devices; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller communicates with other devices using a serial communication protocol. A few non-limiting examples of serial communication protocols that other devices, such as peripherals (e.g., a bill validator or a ticket printer), may use to communicate with the master game controller include USB, RS-232, and Netplex (a proprietary protocol developed by IGT).

In certain embodiments, the at least one memory device is configured to store program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device also stores a plurality of device drivers. Examples of different types of device drivers include device drivers for EGM components and device drivers for the peripheral components. Typically, the device drivers utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device can be upgraded as needed. For instance, when the at least one memory device is a hard drive, new games, new game options, new parameters, new settings for existing parameters, new settings for new parameters, new device drivers, and new communication protocols can be uploaded to the at least one memory device from the master game controller or from some other external device. As another example, when the at least one memory device includes a CD/DVD drive including a CD/DVD configured to store game options, parameters, and settings, the software stored in the at least one memory device can be upgraded by replacing a first CD/DVD with a second CD/DVD. In yet another example, when the at least one memory device uses flash memory or EPROM units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In certain embodiments, the at least one memory device also stores authentication and/or validation components configured to authenticate/validate specified EGM components and/or information, such as hardware components, software components, firmware components, peripheral device components, user input device components, information received from one or more user input devices, information stored in the at least one memory device, etc. Examples of various authentication and/or validation components are described in U.S. Pat. No. 6,620,047, entitled "Electronic Gaming Apparatus Having Authentication Data Sets."

In certain embodiments, in addition to the input, output and other components described in the first section above, the peripheral devices include several device interfaces, such as: (1) at least one additional output device including at least one display device; (2) at least one input device (which may include contact and/or non-contact interfaces); (3) at least one transponder; (4) at least one wireless communication component; (5) at least one wired/wireless power distribution component; (6) at least one sensor; (7) at least one data preservation component; (8) at least one motion/gesture analysis and interpretation component; (9) at least one motion detection component; (10) at least one portable power source; (11) at least one geolocation module; (12) at least one user identification module; (13) at least one player/device tracking module; and (14) at least one information filtering module.

The at least one additional output device includes at least one display device configured to display any game(s) displayed by the EGM and any suitable information associated with such game(s). The display devices are connected to or mounted on a housing of the EGM (described below). In various embodiments, one or more of the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 100 illustrated in FIG. 1 includes at least the first display device 300.

In various embodiments, the additional display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, one or more of the display devices includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGM 100 illustrated in FIG. 1 may include a ticket printer and dispenser. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method".

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device includes one or more sound generating devices controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGM 100 illustrated in FIG. 1 may include a plurality of speakers. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device may include any suitable device that enables an input signal to be produced and received by the at least one processor of the EGM.

In one embodiment, the at least one input device includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGM 100 illustrated in FIG. 1 may include a combined bill and ticket acceptor and a coin slot.

In one embodiment, the at least one input device includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGM 100 illustrated in FIG. 1 may include a game play activation device in the form of a game play initiation button. In other embodiments, the EGM begins game play automatically upon appropriate funding rather than upon utilization of the game play activation device.

In other embodiments, the at least one input device includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGM 100 illustrated in FIG. 1 may include a cashout device in the form of a cashout button.

In various embodiments, the at least one input device includes a plurality of buttons that are programmable by the EGM operator to, when actuated, cause the EGM to perform particular functions. For instance, such buttons may be hard keys, programmable soft keys, or icons displayed on a display device of the EGM (described below) that are actuatable via a touch screen of the EGM (described below) or via use of a suitable input device of the EGM (such as a mouse or a joystick). The example EGM 100 illustrated in FIG. 1 may include a plurality of such buttons.

In certain embodiments, the at least one input device includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device includes a card reader in communication with the at least one processor of the EGM. The example EGM 100 illustrated in FIG. 1 may include a card reader. The card reader is configured to read a player identification card inserted into the card reader.

The at least one wireless communication component includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component transmits electrical, electromagnetic, or optical signals that carry digital data streams or analog signals representing various types of information.

The at least one wired/wireless power distribution component includes components or devices that are configured to provide power to other devices. For example, in one embodiment, the at least one power distribution component includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component is configured to distribute power to one or more internal components of the EGM, such as one or more rechargeable power sources (e.g., rechargeable batteries) located at the EGM.

In certain embodiments, in addition to the components described in the first section above, the at least one sensor includes at least one of: optical sensors, pressure sensors, RF sensors, infrared sensors, image sensors, thermal sensors, and biometric sensors. The at least one sensor 1 may be used for a variety of functions, such as: detecting movements and/or gestures of various objects within a predetermined proximity to the EGM (in addition to the detections described above); detecting the presence and/or identity of various persons (e.g., players, casino employees, etc.), devices (e.g., user input devices), and/or systems within a predetermined proximity to the EGM.

The at least one data preservation component is configured to detect or sense one or more events and/or conditions that, for example, may result in damage to the EGM and/or that may result in loss of information associated with the EGM. Additionally, the data preservation system may be operable to initiate one or more appropriate action(s) in response to the detection of such events/conditions.

In addition to the eye or head tracker described above, the EGM of the present disclosure can also include at least one motion/gesture analysis and interpretation component configured to analyze and/or interpret information relating to detected player movements and/or gestures to determine appropriate player input information relating to the detected player movements and/or gestures. For example, in one embodiment, the at least one motion/gesture analysis and interpretation component is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one geolocation module is configured to acquire geolocation information from one or more remote sources and use the acquired geolocation information to determine information relating to a relative and/or absolute position of the EGM. For example, in one implementation, the at least one geolocation module is configured to receive GPS signal information for use in determining the position or location of the EGM. In another implementation, the at least one geolocation module is configured to receive multiple wireless signals from multiple remote devices (e.g., EGMs, servers, wireless access points, etc.) and use the signal information to compute position/location information relating to the position or location of the EGM.

The at least one user identification module is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module is configured to perform filtering (e.g., based on specified criteria) of selected information to be displayed at one or more displays of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

In certain embodiments, the EGM is a device that has obtained approval from a regulatory gaming commission, and in other embodiments, the EGM is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGM randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the EGM generates the game outcome(s) and/or the award(s) to be provided based on the associated probabilities. In these embodiments, since the EGM generates game outcomes and/or awards randomly or based on one or more probability calculations, there is no certainty that the EGM will ever provide any specific game outcome and/or award.

In certain embodiments, the EGM maintains one or more predetermined pools or sets of predetermined game outcomes and/or awards. In certain such embodiments, upon generation or receipt of a game outcome and/or award request, the EGM independently selects one of the predetermined game outcomes and/or awards from the one or more pools or sets. The EGM flags or marks the selected game outcome and/or award as used. Once a game outcome or an award is flagged as used, it is prevented from further selection from its respective pool or set; that is, the EGM does not select that game outcome or award upon another game outcome and/or award request. The EGM provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the EGM determines a predetermined game outcome and/or award based on the results of a bingo, keno, or lottery game. In certain such embodiments, the EGM utilizes one or more bingo, keno, or lottery games to determine the predetermined game outcome and/or award provided for a primary game and/or a secondary game. The EGM is provided or associated with a bingo card. Each bingo card consists of a matrix or array of elements, wherein each element is designated with separate indicia. After a bingo card is provided, the EGM randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the EGM is configured to communicate with the remote processor, central server, central controller, or remote host for monitoring purposes only. In such embodiments, the EGM determines the game outcome(s) and/or award(s) to be provided in any of the manners described above, and the remote processor, central server, central controller, or remote host monitors the activities and events occurring on the EGM. In one such embodiment, the EGM includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the EGM includes one or more executable game programs executable by at least one processor of the EGM to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the EGM includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the EGM. In certain such embodiments, the EGM includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The EGM enables a wager to be placed on one or more of such paylines to activate such paylines. In other embodiments in which one or more paylines are formed between at least two adjacent symbol display areas, the EGM enables a wager to be placed on a plurality of symbol display areas, which activates those symbol display areas.

In various embodiments, the EGM provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the EGM employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the EGM includes a progressive award. Typically, a progressive award includes an initial amount and an additional amount funded through a portion of each wager placed to initiate a play of a primary game. When one or more triggering events occurs, the EGM provides at least a portion of the progressive award. After the EGM provides the progressive award, an amount of the progressive award is reset to the initial amount and a portion of each subsequent wager is allocated to the next progressive award. Examples of progressive gaming systems or EGMs are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the EGM provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the EGM automatically provides or initiates the secondary game upon the occurrence of a triggering event or the satisfaction of a qualifying condition. In other embodiments, the EGM initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the EGM randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the EGM determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system or EGM includes one or more player tracking systems. Such player tracking systems enable operators of the gaming system or EGM (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the EGM to begin a gaming session, the card reader reads the player identification number off the player tracking card to identify the player. The EGM timely tracks any suitable information or data relating to the identified player's gaming session. The EGM also timely tracks when the player tracking card is removed to conclude play for that gaming session. In another embodiment, rather than requiring insertion of a player tracking card into the card reader, the EGM utilizes one or more portable devices, such as a mobile phone, a radio frequency identification tag, or any other suitable wireless device, to track when a gaming session begins and ends. In another embodiment, the EGM utilizes any suitable biometric technology or ticket technology to track when a gaming session begins and ends.

In such embodiments, during one or more gaming sessions, the EGM tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the first display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Certain of the gaming systems described herein, including EGMs located in a casino or another gaming establishment, include certain components and/or are configured to operate in certain manners that differentiate these EGMs and systems from general purpose computing devices (i.e., certain personal gaming devices such as desktop computers and laptop computers).

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are typically not state-based machines, and a majority of data can be lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents in a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

It should further be appreciated that the EGM of the present disclosure may have varying or alternative housing configurations.

In various embodiments, the EGM of the present disclosure is configured to be positioned on a base or stand.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electronic gaming machine comprising:

a housing; and a movable display device supported by the housing, the movable display device comprising:

a supporting frame, a stretchable organic light-emitting diode ("OLED") display configured to move to a first position wherein the stretchable OLED display is in a substantially flat position, and to a different second position wherein the stretchable OLED display is curved in a first direction, and a display actuator connecting the stretchable OLED display to the supporting frame, the display actuator comprising an upper display actuator pivotally connected to a lower display actuator and configured to move the stretchable OLED display to the first position, from the first position to the second position, and from the second position to the first position.

2. The electronic gaming machine of claim 1, which comprises a processor and a memory device that stores a plurality of instructions, which when executed by the processor, cause the movable display device to display a first set of game displays in the first position and a different second set of game displays in the second position.

3. The electronic gaming machine of claim 2, where the first set of game displays comprise images that are part of a primary wagering game, and the second set of game displays comprise images that are part of a secondary game.

4. The electronic gaming machine of claim 1, which comprises a processor and a memory device that stores a plurality of instructions, wherein the plurality of instructions, when executed, cause the processor to cause the movable display device to display a play of a first game in the first position, and cause the display device to display a second different game in the second position.

5. The electronic gaming machine of claim 1, wherein the stretchable OLED display comprises a screen supporter, an image display screen supported by the screen supporter, and a touch screen supported by the screen supporter.

6. The electronic gaming machine of claim 5, wherein the display actuator comprises the upper display actuator connected to an upper rear portion of the screen supporter and the lower display actuator connected to a lower rear portion of the screen supporter.

7. The electronic gaming machine of claim 6, wherein each of the upper and lower display actuators comprises a body connected to a first area of the rear portion of the screen supporter, a first bendable arm extending from a first side of the body and connected to a first side area of the rear portion of the screen supporter, a second bendable arm extending from a second side of the body and connected to a second side area of the rear portion of the screen supporter, a first arm mover assembly connected to the body and the first arm, and a second arm mover assembly connected to the body and the second arm.

8. The electronic gaming machine of claim 7, wherein the first bendable arm comprises a plurality of connected first arm sections that are movable with respect to one another.

9. The electronic gaming machine of claim 8, wherein the first arm mover assembly comprises a first pivot member pivotally connected to a first bracket of the first arm, a first flexible member comprising an outer end connected to the first pivot member, a first flexible member actuator connected to an inner end of the first flexible member, wherein the first flexible member actuator of the first arm mover assembly is configured to apply tension to and pull the first flexible member inwardly and closer to the body to apply force to the first arm which in turn applies force to move the screen supporter to pull the screen from the second position to the first position.

10. The electronic gaming machine of claim 1, wherein the first direction is a horizontal direction.

11. The electronic gaming machine of claim 1, wherein when the stretchable OLED display is in the second position it is configured to cover a majority of a player's side-to-side field of view.

12. The electronic gaming machine of claim 1, wherein when the stretchable OLED display is in the second position it is configured to cover approximately 180 degrees of a player's side-to-side field of view.

13. An electronic gaming machine comprising:

a housing;

a movable display device supported by the housing, the movable display device comprising:

a supporting frame, a stretchable organic light-emitting diode ("OLED") display connected to a screen supporter, said display and said screen supporter configured to move to a first position wherein the stretchable OLED display is in a substantially flat position, and to a different second position wherein the stretchable OLED display is curved in a first direction, and a display actuator connecting the screen supporter, and configured to move the screen supporter and the stretchable OLED display to the first position, from the first position to the second position, and from the second position to the first position, the display actuator comprising a body connected to the screen supporter and a bendable arm extending from the body, the bendable arm comprising a plurality of connected arm sections that are moveable with respect to one another;

a processor; and a memory device that stores a plurality of instructions, which when executed by the processor, cause the movable display device to display a first set of game displays in the first position and a different second set of game displays in the second position.

14. The electronic gaming machine of claim 13, where the first set of game displays comprises images that are part of a primary wagering game, and the second set of game displays comprise images that are part of a secondary game.

15. The electronic gaming machine of claim 13, wherein the display actuator comprises an upper display actuator connected to an upper rear portion of the screen supporter and a lower display actuator connected to a lower rear portion of the screen supporter, wherein the upper display actuator comprises the body connected to a first area of the upper rear portion of the screen supporter, the bendable arm extending from a first side of the body and connected to a first side area of the upper rear portion of the screen supporter, a second bendable arm extending from a second side of the body and connected to a second side area of the upper rear portion of the screen supporter, a first arm mover assembly connected to the body and the bendable arm, and a second arm mover assembly connected to the body and the second bendable arm, and wherein the lower display actuator comprises a second body connected to a first area of the lower rear portion of the screen supporter, a first bendable arm extending from a first side of the second body and connected to a first side area of the lower rear portion of the screen supporter, a second bendable arm extending from a second side of the second body and connected to a second side area of the lower rear portion of the screen supporter, a first arm mover assembly connected to the second body and the first bendable arm, and a second arm mover assembly connected to the second body and the second bendable arm.

16. The electronic gaming machine of claim 15, wherein the first bendable arm of the lower display actuator comprises a plurality of connected first arm sections that are movable with respect to one another.

17. The electronic gaming machine of claim 15, wherein the first arm mover assembly of the upper display actuator comprises a first pivot member pivotally connected to a first bracket of the bendable arm, a first flexible member comprising an outer end connected to the first pivot member, a first flexible member actuator connected to an inner end of the first flexible member, wherein the first flexible member actuator of the first arm mover assembly is configured to apply tension to and pull the first flexible member inwardly and closer to the body to apply force to the bendable arm which in turn applies force to move the screen supporter to pull the screen from the second position to the first position, wherein the first arm mover assembly of the lower display actuator comprises a first pivot member pivotally connected to a first bracket of the first bendable arm, a first flexible member comprising an outer end connected to the first pivot member, a first flexible member actuator connected to an inner end of the first flexible member, wherein the first flexible member actuator of the first arm mover assembly is configured to apply tension to and pull the first flexible member inwardly and closer to the body to apply force to the first bendable arm which in turn applies force to move the screen supporter to pull the screen from the second position to the first position.

18. The electronic gaming machine of claim 13, wherein the first direction is a horizontal direction.

19. The electronic gaming machine of claim 13, wherein when the stretchable OLED display is in the second position it is configured to cover a majority of a player's side-to-side field of view.

20. The electronic gaming machine of claim 13, wherein when the stretchable OLED display is in the second position it is configured to cover approximately 180 degrees of a player's side-to-side field of view.

21. An electronic gaming machine comprising:

a housing; and a movable display device supported by the housing, the movable display device comprising:

a supporting frame, a stretchable organic light-emitting diode ("OLED") display comprises a screen supporter and an image display screen supported by the screen supporter, the stretchable OLED display configured to move to a first position wherein the stretchable OLED display is in a substantially flat position, and to a different second position wherein the stretchable OLED display is curved in a first direction, and a display actuator configured to move the stretchable OLED display to the first position, from the first position to the second position, and from the second position to the first position, the display actuator comprising an upper display actuator connected to an upper rear portion of the screen supporter and a lower display actuator connected to a lower rear portion of the screen supporter, wherein each of the upper and lower display actuators comprises a body connected to a first area of the rear portion of the screen supporter, a first bendable arm extending from a first side of the body and connected to a first side area of the rear portion of the screen supporter, the first bendable arm comprising a plurality of connected first arm sections that are movable with respect to one another, a second bendable arm extending from a second side of the body and connected to a second side area of the rear portion of the screen supporter, a first arm mover assembly connected to the body and the first arm, and a second arm mover assembly connected to the body and the second arm.

* * * * *